US008820659B2

(12) United States Patent
Wesch et al.

(10) Patent No.: US 8,820,659 B2
(45) Date of Patent: Sep. 2, 2014

(54) ROTOR NOZZLE FOR A HIGH-PRESSURE CLEANING APPLIANCE

(75) Inventors: Johann Georg Wesch, Urbach (DE); Kai Trautwein, Leutenbach-Weiler zum Stein (DE)

(73) Assignee: Alfred Kaercher GmbH & Co. KG, Winnenden (DE)

( * ) Notice: Subject to any disclaimer, the term of this patent is extended or adjusted under 35 U.S.C. 154(b) by 216 days.

(21) Appl. No.: 13/299,459

(22) Filed: Nov. 18, 2011

(65) Prior Publication Data

US 2012/0138706 A1 Jun. 7, 2012

Related U.S. Application Data

(63) Continuation of application No. PCT/EP2010/057080, filed on May 21, 2010.

(30) Foreign Application Priority Data

May 25, 2009 (DE) ..... 10 2009 023 647

(51) Int. Cl.
*B05B 3/04* (2006.01)

(52) U.S. Cl.
USPC ..... 239/237; 239/240; 239/263; 239/264; 239/381; 239/DIG. 4

(58) Field of Classification Search
USPC ..... 239/237, 240, 263, 264, 380, 381, 239/DIG. 4
See application file for complete search history.

(56) References Cited

U.S. PATENT DOCUMENTS

| | | | |
|---|---|---|---|
| 996,480 | A | 6/1911 | Glaser |
| 1,097,410 | A | 5/1914 | Flack et al. |
| 1,862,381 | A | 6/1932 | Le Moon |
| 1,919,244 | A | 7/1933 | Munz |
| 1,970,126 | A | 8/1934 | Buckner |
| 2,290,979 | A | 7/1942 | Luce |
| 2,758,874 | A | 8/1956 | Snyder |
| 2,785,926 | A | 3/1957 | Lataste |
| 2,854,283 | A | 9/1958 | Hruby, Jr. |
| 2,967,024 | A | 1/1961 | Aubert |
| 2,974,877 | A | 3/1961 | Hruby, Jr. |

(Continued)

FOREIGN PATENT DOCUMENTS

| | | |
|---|---|---|
| AT | 358 417 | 9/1980 |
| CH | 339340 | 6/1959 |

(Continued)

*Primary Examiner* — Steven J Ganey
(74) *Attorney, Agent, or Firm* — Lipsitz & McAllister, LLC

(57) ABSTRACT

A rotor nozzle for a high-pressure cleaning appliance is provided. The rotor nozzle has a housing, which comprises at least one inlet opening tangentially, and which is provided in a front wall with a pan-shaped depression with a central opening. A nozzle body is arranged in the housing and supported with a spherical end in the pan-shaped depression. A longitudinal axis of the nozzle body is inclined to the longitudinal axis of the housing, it being possible for liquid in the housing to be caused to rotate about the longitudinal axis, and the nozzle body rotating together with the rotating liquid. In order to reduce flow losses in the rotor nozzle, without the operation of the rotor nozzle (in particular, start-up behavior of the nozzle body) being noticeably impaired, the nozzle body is provided with an outer contour deviating from the circular shape in a rear end area.

14 Claims, 2 Drawing Sheets

(56) References Cited

U.S. PATENT DOCUMENTS

| | | | | |
|---|---|---|---|---|
| 3,107,056 | A | 10/1963 | Hunter | |
| 3,126,025 | A | 3/1964 | Aubert et al. | |
| 3,326,468 | A | 6/1967 | Bristow et al. | |
| 3,874,595 | A | 4/1975 | Rindisbacher | |
| 4,073,438 | A | 2/1978 | Meyer | |
| 4,202,495 | A | 5/1980 | Kränzle | |
| 4,228,559 | A | 10/1980 | Kirk | |
| 4,320,929 | A | 3/1982 | Clark et al. | |
| 4,392,617 | A | 7/1983 | Bakos et al. | |
| 4,407,678 | A | 10/1983 | Furness et al. | |
| 4,681,260 | A | 7/1987 | Cochran | |
| 4,708,290 | A | 11/1987 | Osmond | |
| 4,714,200 | A | 12/1987 | Sayama | |
| 4,732,325 | A | 3/1988 | Jensen et al. | |
| 4,747,544 | A | 5/1988 | Kränzle | |
| 4,802,628 | A | 2/1989 | Dautel et al. | |
| 4,951,877 | A | 8/1990 | Arsi | |
| 4,989,786 | A | 2/1991 | Kränzle et al. | |
| 5,108,035 | A | 4/1992 | Friedrichs | |
| 5,217,166 | A | 6/1993 | Schulze et al. | |
| 5,236,126 | A | 8/1993 | Sawade et al. | |
| 5,328,097 | A | 7/1994 | Wesch et al. | |
| 5,332,155 | A | 7/1994 | Jäger | |
| 5,395,053 | A | 3/1995 | Frech | |
| 5,551,635 | A | 9/1996 | Jäger | |
| 5,598,975 | A | 2/1997 | Jäger | |
| 6,029,906 | A | 2/2000 | Binder et al. | |
| 6,196,475 | B1 | 3/2001 | Jaeger | |
| 6,250,566 | B1 * | 6/2001 | Jager | 239/237 |
| 6,736,333 | B2 * | 5/2004 | Binder et al. | 239/381 |
| 2007/0289616 | A1 | 12/2007 | McCadden et al. | |
| 2008/0265058 | A1 | 10/2008 | Wimmer | |

FOREIGN PATENT DOCUMENTS

| | | |
|---|---|---|
| DE | 1 139 947 | 11/1962 |
| DE | 2 425 475 | 12/1974 |
| DE | 78 13 438 | 9/1978 |
| DE | 78 27 011 | 1/1979 |
| DE | 27 53 444 | 6/1979 |
| DE | 79 29 277 | 2/1980 |
| DE | 31 50 879 | 8/1982 |
| DE | 34 19 964 | 12/1985 |
| DE | 36 23 368 | 9/1987 |
| DE | 88 01 795 | 5/1988 |
| DE | 37 00 587 | 7/1988 |
| DE | 89 09 876 | 11/1989 |
| DE | 39 02 478 | 7/1990 |
| DE | 90 04 452 | 8/1990 |
| DE | 39 15 962 | 9/1990 |
| DE | 39 25 284 | 2/1991 |
| DE | 40 13 446 | 5/1991 |
| DE | 41 29 026 | 3/1993 |
| DE | 43 19 743 | 12/1994 |
| DE | 44 33 646 | 10/1996 |
| DE | 10 2004 047 586 | 4/2006 |
| DE | 20 2007 005 846 | 8/2007 |
| DE | 20 2007 006 088 | 8/2007 |
| DE | 10 2007 051 810 | 5/2009 |
| EP | 0 068 097 | 1/1983 |
| EP | 0 153 129 | 8/1985 |
| EP | 35 32 045 | 3/1987 |
| EP | 0 216 034 | 4/1987 |
| EP | 0 252 261 | 1/1988 |
| EP | 0 379 654 | 8/1990 |
| EP | 0 956 905 | 11/1999 |
| FR | 2 602 987 | 2/1988 |
| GB | 928 333 | 6/1963 |
| GB | 2 152 851 | 8/1985 |
| GB | 2 155 817 | 10/1985 |
| WO | 95/32804 | 12/1995 |
| WO | 2008/004030 | 1/2008 |
| WO | 2008/056218 | 5/2008 |

* cited by examiner

ROTOR NOZZLE FOR A HIGH-PRESSURE CLEANING APPLIANCE

This application is a continuation of international application number PCT/EP2010/057080 filed on May 21, 2010 and claims the benefit of German application number 10 2009 023 647.3 filed on May 25, 2009.

The present disclosure relates to the subject matter disclosed in international application number PCT/EP2010/057080 of May 21, 2010 and German application number 10 2009 023 647.3 of May 25, 2009, which are incorporated herein by reference in their entirety and for all purposes.

BACKGROUND OF THE INVENTION

The invention relates to a rotor nozzle for a high-pressure cleaning appliance with a housing, which comprises at least one inlet for a liquid opening tangentially into the housing, and which is provided in a front wall with a pan-shaped depression with a central opening, and with a nozzle body arranged in the housing, the nozzle body having a through-channel and being supported with a spherical end in the pan-shaped depression, and the longitudinal axis of the nozzle body being inclined to the longitudinal axis of the housing, it being possible for liquid in the housing to be caused to rotate about the longitudinal axis of the housing by the liquid flowing via the at least one inlet into the housing, and the nozzle body rotating together with the rotating liquid and in doing so bearing with a contact surface at its circumference against the inside wall of the housing.

Such rotor nozzles are known, for example, from DE 41 29 026 C1. With these a compact jet of liquid circulating on the surface of a cone can be generated, which, for example, for cleaning purposes can be directed onto a surface to be cleaned. For this purpose, the inlet of the housing can be connected to a high-pressure cleaning appliance, so that liquid under high pressure can be supplied to the housing. In the housing there is located a nozzle body, which is only mounted at one side on the pan-shaped depression and otherwise can move in the housing about the longitudinal axis of the housing. The nozzle body has a through-channel through which the liquid can pass through the depression of the housing, which has an opening. The longitudinal axis of the nozzle body is inclined in relation to the longitudinal axis of the housing. Owing to the liquid entering the housing tangentially, the nozzle body is pressed into the pan-shaped depression, which forms a bearing for the nozzle body, and, at the same time, the nozzle body is caused to rotate about the longitudinal axis of the housing. As a consequence of this, the exiting jet of liquid also describes the desired circular movement, so that a relatively large surface can be acted upon with liquid at a pressure comparable to spot jet nozzles.

The supplying of the liquid under pressure via the inlet opening tangentially into the housing ensures that liquid located in the housing is rotated about the longitudinal axis of the housing and the nozzle body is thereby also rotated about the longitudinal axis of the housing by a rotating liquid column forming inside the housing. The at least one tangential inlet does, however, form a flow resistance for the liquid, which results in flow losses. In order to reduce the flow resistance, the diameter of the at least one tangential inlet could be increased. However, this then has the consequence that the flow velocity of the liquid in the area of the at least one tangential inlet is reduced, and this, in turn, may have the consequence that the nozzle body cannot in all cases, be reliably caused to rotate about the longitudinal axis of the housing. In particular, the so-called "start-up behavior" of the nozzle body may be impaired. Start-up behavior is to be understood as initiation of the rotation of the nozzle body. Before liquid under pressure is supplied to the housing, the nozzle body is at rest relative to the inside wall of the housing, i.e., it is not yet executing a rotational movement about the longitudinal axis of the housing. When liquid under pressure is now supplied via the at least one tangential inlet, the static friction between the nozzle body and the inside wall of the housing must first be overcome in order to be able to cause the nozzle body to rotate. A relatively large initial frictional force must, therefore, first be overcome in order to move the nozzle body. When the nozzle body then executes a rotational movement, it is the sliding friction, which is usually smaller than the initial static friction, that is then responsible for the frictional behavior of the nozzle body at the inside wall of the housing. As a consequence of this, a lower force is required for maintaining a rotational movement of the nozzle body about the longitudinal axis of the housing than for initiating the movement.

If the flow cross section of the at least one tangential inlet is now increased, in order to reduce flow losses in the area of the inlet, the flow velocity of the liquid in the area of the inlet is thereby reduced, and this may, in turn, have the consequence that the force exerted by the liquid on the nozzle body is not sufficient to cause the nozzle body to rotate about the longitudinal axis of the housing.

The object of the present invention is to so develop a rotor nozzle of the kind mentioned at the outset that flow losses can be reduced in the area of the rotor nozzle without operation of the rotor nozzle, in particular, start-up behavior of the nozzle body, thereby being noticeably impaired.

SUMMARY OF THE INVENTION

This object is accomplished, in accordance with the invention, with a rotor nozzle of the generic kind in that the nozzle body has an outer contour deviating from the circular shape in a rear end area facing away from the front, spherical end.

Owing to the outer contour deviating from the circular shape in the rear end area of the nozzle body, a force by means of which the nozzle body is caused to rotate about the longitudinal axis of the housing can be transferred more effectively to the nozzle body by the liquid rotating in the housing. This, in turn, makes it possible to increase the flow cross section of the at least one inlet opening tangentially into the housing, without operation of the rotor nozzle and, in particular, start-up behavior of the nozzle body being thereby adversely affected. As a result of increasing the flow cross section of the at least one inlet, the flow velocity of the liquid is reduced in the area of the inlet, but owing to the outer contour deviating from the circular shape in the rear end area of the nozzle body, this does not impair its start-up behavior. Rather, the nozzle body is also reliably caused to rotate by the rotating liquid flowing in the housing about its longitudinal axis when the flow cross section of the at least one tangential inlet is increased.

Therefore, flow losses of the liquid in the area of the rotor nozzle can be reduced by the outer contour deviating from the circular shape in the rear end area of the nozzle body, and yet it is ensured that a cleaning jet under high pressure circulating on the surface of a cone can be reliably generated by the rotor nozzle.

It is advantageous for the area of the nozzle body with an outer contour deviating from the circular shape to extend right up to the rear end of the nozzle body. It has been found that this allows a particularly effective transfer of forces from the liquid rotating about the longitudinal axis of the housing to the nozzle body.

In its area with an outer contour deviating from the circular shape, the nozzle body is of non-circular configuration, which allows an effective transfer of forces from the rotating liquid to the nozzle body. For example, the nozzle body may have an oval shape or an undulating outer contour in this area.

A construction has proven particularly effective, in which the nozzle body is of angular configuration in the area with an outer contour deviating from the circular shape. In this area, the nozzle body may, for example, be of star-shaped configuration or in the form of a polygon, in particular, a square or a hexagon. The provision of edges in the area of the outer contour of the nozzle body enables a particularly efficient transfer of forces from the liquid rotating about the longitudinal axis of the housing to the nozzle body so that it follows the movement of the liquid and also rotates about the longitudinal axis of the housing.

In an advantageous configuration of the invention, the nozzle body has outwardly protruding ribs in its rear end area. The ribs impart an outer contour deviating from the circular shape to the nozzle body.

It is particularly advantageous for at least some ribs to extend in a radial plane in relation to the longitudinal axis of the nozzle body. The nozzle body may, for example, comprise a plurality of ribs distributed uniformly in the circumferential direction, which are each radially orientated.

As an alternative or supplement, it may be provided that at least some ribs extend perpendicularly to a radial plane in relation to the longitudinal axis of the nozzle body. Here radial plane is to be understood as a plane which is orientated in the radial direction in relation to the longitudinal axis of the nozzle body.

A plurality of ribs are preferably aligned parallel to one another.

The liquid rotating in the housing about its longitudinal axis may not only result in the nozzle body rotating in accordance with the liquid about the longitudinal axis of the housing. The liquid rotating about the longitudinal axis of the housing may, in particular, in the front area of the nozzle body with which it is mounted in the central, pan-shaped depression act as rotary drive for the nozzle body about its longitudinal axis, so that the nozzle body is caused to rotate inherently about its own longitudinal axis. The rotational movement of the nozzle body on the conical surface of the housing is superimposed by the inherent rotation about the longitudinal axis of the nozzle body. The inherent rotation results in the liquid jet that exits from the nozzle body also being made to rotate about its longitudinal axis. Once the liquid particles accelerated accordingly in the circumferential direction leave the nozzle body the liquid jet can, therefore, fan out. This may have the consequence that the cleaning effect of the liquid jet already deteriorates at a short distance from the nozzle body. To keep the inherent rotation of the nozzle body low, it is advantageous for the nozzle body to have a circular outer contour in its end area facing the front, spherical end. The transfer of forces from the liquid rotating in the housing to the nozzle body is reduced in the front area of the nozzle body by the circular outer contour. The risk of the liquid jet fanning out after leaving the nozzle body is thereby kept slight. In such a configuration, the nozzle body, therefore, has in its rear end area an outer contour deviating from the circular shape, which improves the start-up behavior of the nozzle body, and in its front end area, the nozzle body has a circular outer contour, which keeps the inherent rotation of the nozzle body about its own longitudinal axis low.

A cylindrical configuration of the nozzle body in its front end area is particularly advantageous.

Preferably, the area with a circular outer contour extends over at least half of the total length of the nozzle body. In such a configuration, the nozzle body has an outer contour deviating from the circular shape in its rear end area. However, this area extends, at most, over half of the total length of the nozzle body.

The area of the nozzle body with an outer contour deviating from the circular shape is preferably shorter in relation to the longitudinal axis of the nozzle body than the area with a circular outer contour.

In particular, it may be provided that the area with an outer contour deviating from the circular shape extends in the longitudinal direction of the nozzle body over an area of at most 40% of the total length of the nozzle body. It has been found that a particularly good start-up behavior with relatively low inherent rotation of the nozzle body is thereby achievable.

As mentioned at the outset, the nozzle body rotating about the longitudinal axis of the housing bears with a contact surface against the inside wall of the housing. The contact surface is preferably formed by an annular bead which is rotationally fixedly connected to the nozzle body.

It is expedient for the annular bead to be followed in the longitudinal direction of the nozzle body on both sides by areas with an outer contour deviating from the circular shape. In such a configuration, the annular bead is arranged at a distance from the rear end of the nozzle body, and the nozzle body has an outer contour deviating from the circular shape both in the area between the annual bead and the rear end of the nozzle body and in the area following the annular bead in the direction towards the front end of the nozzle body. A relatively large force can thereby be transferred by the liquid rotating about the longitudinal axis of the housing to the nozzle body on both sides of the annular bead, i.e., on both sides of the contact surface. It has been found that the start-up behavior of the nozzle body can thereby be improved.

The annular bead can be formed by, for example, an O-ring which is connected in a frictionally engaged manner to the nozzle body and is arranged in an annular groove surrounding the nozzle body.

The annular bead, in particular, the O-ring, is preferably made of a rubber-elastic material.

The inherent rotation of the nozzle body, explained above, about its own longitudinal axis can be reduced by the nozzle body comprising in its rear end area a mass element which increases the centrifugal force. Owing to its rotational movement about the longitudinal axis of the housing, the nozzle body is subject to a centrifugal force which acts upon the nozzle body perpendicularly to the longitudinal axis of the housing and presses the nozzle body against the inside wall of the housing. The inherent rotation of the nozzle body about its own longitudinal axis is thereby impeded. The centrifugal force acting on the nozzle body can be reinforced by the mass of the nozzle body being increased in its rear end area. It is, therefore, expedient for it to comprise a mass element, for example, a metal body, in this end area.

A spherical mass element, for example, a metal ball, in particular, a steel ball, is preferably used.

The liquid supplied to the housing via the at least one tangential inlet can only leave the housing by flowing through the through-channel of the nozzle body and then passing through the depression, which has an opening, at the front wall of the housing. The through-channel expediently extends in the axial direction through the nozzle body. The liquid can, therefore, enter the through-channel at the rear end of the nozzle body and leave the through-channel at the front end of the nozzle body. It has been found that the cleaning effect of the rotor nozzle is improved by such a through-channel. The through-channel has a relatively large length. Turbulences in the flow of liquid are thereby calmed. Such turbulences can cause a fanning-out of the jet of liquid flowing out of the nozzle body. The risk of turbulences is reduced by the relatively large length of the through-channel.

It is particularly expedient for a flow straightener to be arranged in the through-channel as turbulences in the jet of liquid can thereby be calmed particularly effectively. The flow straightener may comprise walls which extend parallel to the longitudinal axis of the nozzle body and pass diametrically through the through-channel. In particular, it may be provided that the flow straightener comprises two walls extending perpendicularly to each other and parallel to the through-channel and passing diametrically through the through-channel.

A mass element which increases the centrifugal force and around which the liquid flows is expediently arranged in the rear end area of the through-channel. The mass element may be pressed into the through-channel. This facilitates assembly of the nozzle body.

It is particularly advantageous for a flow straightener which follows the mass element in the direction towards the front, spherical end of the nozzle body to be arranged in the through-channel. In such a configuration, the liquid can flow axially through the nozzle body, with it entering the through-channel at the rear end of the nozzle body and first flowing around the preferably spherical or cylindrical mass element. The liquid then flows through the flow straightener following the mass element in the direction towards the front end of the nozzle body. The flow straightener brings about a calming of the jet of liquid by turbulences in the jet of liquid being attenuated. A practically turbulence-free flow of liquid can be achieved, so that the risk of the jet of liquid fanning out as it leaves the nozzle body is particularly slight.

The following description of a preferred embodiment of the invention serves for a more detailed explanation in conjunction with the drawings.

DETAILED DESCRIPTION OF THE INVENTION

Figure 1:
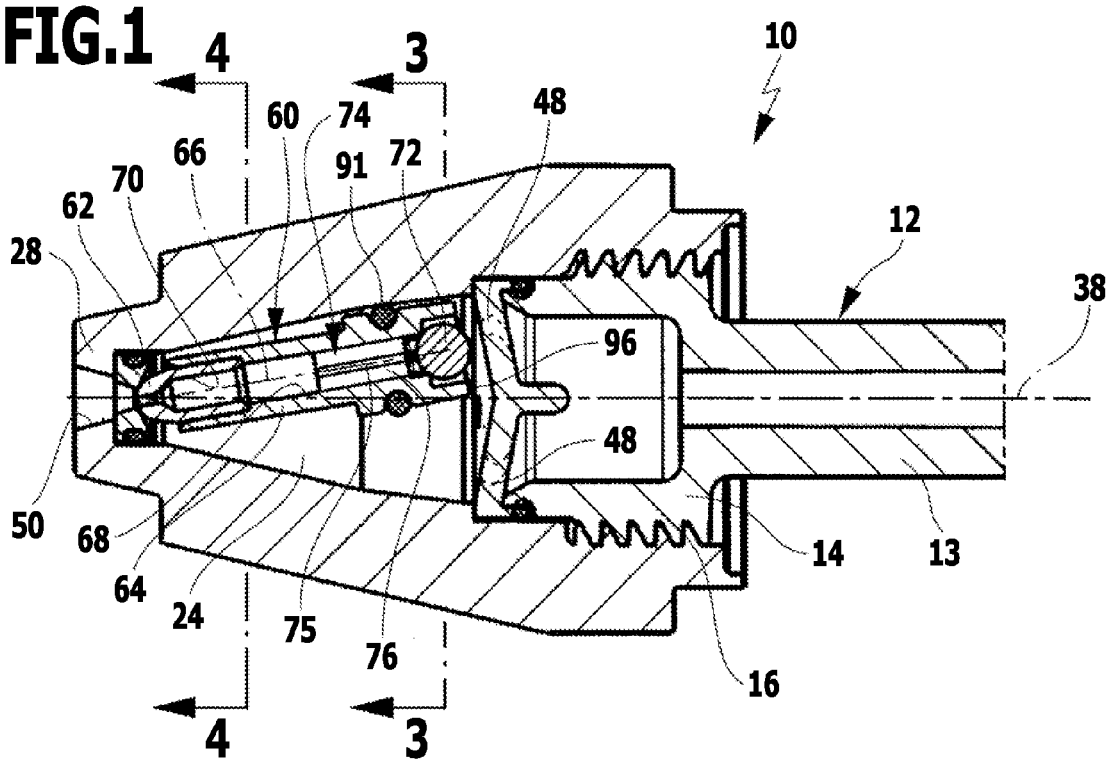
FIG. 1 shows a diagrammatical longitudinal section through a rotor nozzle in accordance with the invention with a housing in which a nozzle body is arranged.

A rotor nozzle 10 for a high-pressure cleaning appliance, not represented in the drawings, is shown diagrammatically in the drawings. The rotor nozzle 10 is screwed onto a jet pipe 12 of the high-pressure cleaning appliance. The jet pipe 12 is only partially reproduced in the drawings as it is known per se to the person skilled in the art. It comprises a pipe section 13, at whose end, not shown in the drawings, facing away from the rotor nozzle 10, the pressure hose of the high-pressure cleaning appliance can be connected in the usual manner, and also a connecting section 14 with an external thread 16 for releasable connection of the jet pipe 12 to the rotor nozzle 10.

The rotor nozzle 10 comprises a housing 20 with a first housing part 21 and a second housing part 22, which define an interior 24. The first housing part 21 has a frustoconical front housing section 26 with a front wall 28 and a casing 30, and a rear housing section 32, which integrally adjoins the front housing section 26 and is of hollow-cylindrical configuration. It carries an internal thread 34 into which the connecting section 14 of the jet pipe 12 is screwed with its external thread 16. Adjoining the internal thread 34 in the direction towards the front wall 28 is a cylindrical sealing section 36, which continues into the substantially frustoconical interior 24 via a shoulder 40 which is directed radially inwardly in relation to the longitudinal axis 38 of the housing 20.

The second housing part 22 is configured in the form of an end plate 42, which delimits the interior 24 in the axial direction, and bears, on the one hand, against the shoulder 40 and, on the other hand, against the free end 44 of the jet pipe 12. Adjoining the end plate 42 in the direction facing away from the front wall 28 is a sealing ring 46 which surrounds the jet pipe 12 in the circumferential direction and ensures a liquid-tight connection of the jet pipe 12 to the rotor nozzle 10.

The end plate 42 comprises a plurality of, preferably four, tangential inlets 48 spaced equidistantly from one another in the circumferential direction, via which liquid supplied to the rotor nozzle 10 via the jet pipe 12 from a high-pressure cleaning appliance can enter the interior 24. Owing to the tangential orientation of the inlets 48, the liquid entering the interior 24 has a directional component orientated tangentially in relation to the longitudinal axis 38. Liquid is thereby caused to rotate about the longitudinal axis 38 of the housing 20 in the interior 24.

The front wall 28 of the front housing section 26 has a central opening 50, which widens conically in the direction facing away from the end plate 42. On the inside, the central opening 50 is surrounded by a pan-shaped bearing ring 52, which carries on the outside a sealing ring 54 and is thereby sealed off from the front housing section 26.

The spherical front end 56 of a nozzle body 60 is supported in the bearing ring 52. The nozzle body 60 is of multipart configuration. It comprises a nozzle 62, which forms the front end 56 of the nozzle body 60, and a nozzle carrier 64 with a through-channel 68, which extends in the axial direction along the longitudinal axis 66 of the nozzle body 60 and into which the nozzle 62 is pressed with a nozzle channel 70 which is aligned with the through-channel 68. The through-channel 68 widens stepwise in its end area that faces away from the nozzle 62. Pressed into the through-channel 68 in the area of the widening is a mass body in the form of a steel ball 72 which increases the centrifugal force. Adjoining the steel ball 72 in the through-channel 68 in the direction of the nozzle 62 is a flow straightener 74, which comprises two walls 75, 76, which extend perpendicularly to each other, run parallel to the longitudinal axis 66 of the nozzle body 60 and pass diametrically through the through-channel 68.

Liquid can flow around the steel ball 72 in the through-channel 68. After passing through the flow straightener 74 and the nozzle 62, this liquid can, therefore, flow through the bearing ring 62 and the central opening 50 and thereby leave the rotor nozzle 10.

The nozzle carrier 64 has a front peripheral area 78 with a circular outer contour and an adjoining rear peripheral area 80 with an outer contour that deviates from the circular shape. The outer contour of the rear peripheral area 80, which deviates from the circular shape is formed by ribs 82, 83, 84, 85, 86, 87, 88, 89 which protrude from the outside of the nozzle carrier 64. This will be clear, in particular, from FIG. 3. The ribs 82 and 86 are diametrically opposed and are each radially orientated in relation to the longitudinal axis 66 of the nozzle body 60. In a corresponding manner, the ribs 84 and 88 are diametrically opposed and radially orientated. In contrast thereto, the ribs 83 and 89 are orientated in alignment with each other and parallel to the ribs 84 and 88, and the ribs 85 and 87 are also orientated in alignment with each other and parallel to the ribs 84 and 88. The spacing of the ribs 85 and 87 from the ribs 84 and 88, respectively, is identical to the spacing of the ribs 83 and 89 from the ribs 84 and 88, respectively.

Figure 2:
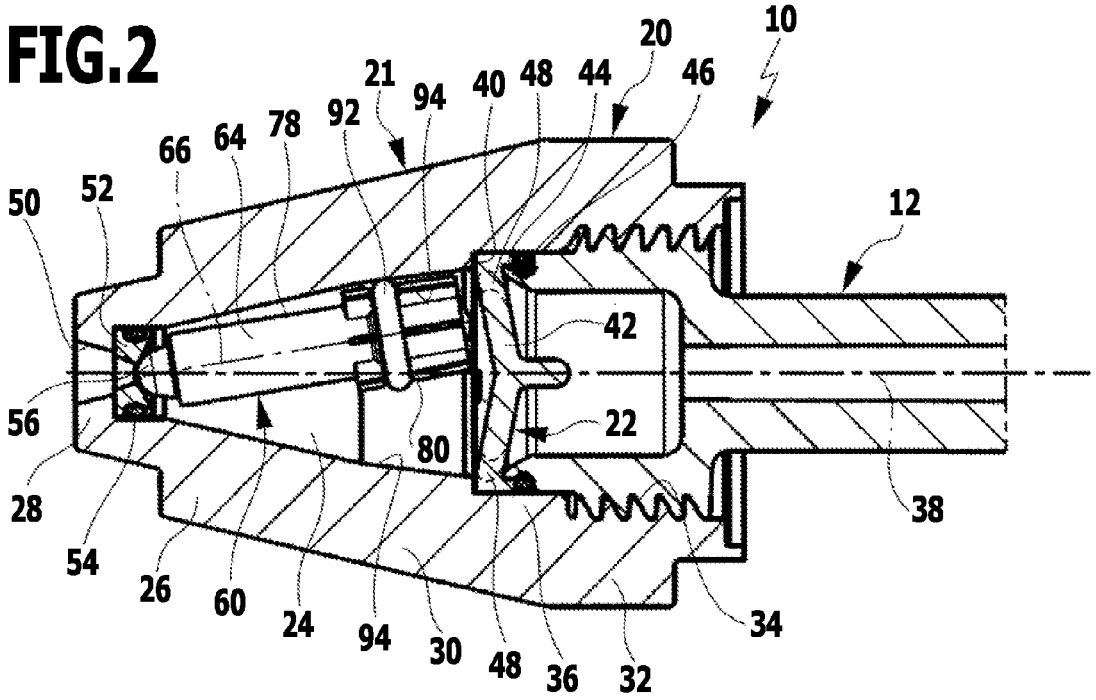
FIG. 2 shows a side view of the nozzle body with the housing cut in the longitudinal direction.

At the level of the ribs 82 to 89, the nozzle carrier 64 comprises in the rear peripheral area 80 an annular groove 91 which extends in the circumferential direction and in which an O-ring 92 is held in a frictionally engaged and thereby rotationally fixed manner. In relation to the longitudinal axis 66 of the nozzle body 60, the O-ring protrudes in the radial direction beyond the ribs 82 to 89. It forms a contact surface with which the nozzle body 60 can be made to bear against the inside wall 94 of the housing 20. As will be clear, in particular, from FIGS. 1 and 2, the ribs 82 to 89 extend in the axial direction on either side of the O-ring 92, and they run up to the rear end 96 of the nozzle body 60 that faces away from the front end 56.

In the axial direction, the ribs 82 to 89 extend over less than half of the total length of the nozzle body 60. In the illustrated embodiment, the length of the ribs 82 to 89 is less than 40% of the total length of the nozzle body 60, for example, 30% to 35% of the total length.

Figure 3:
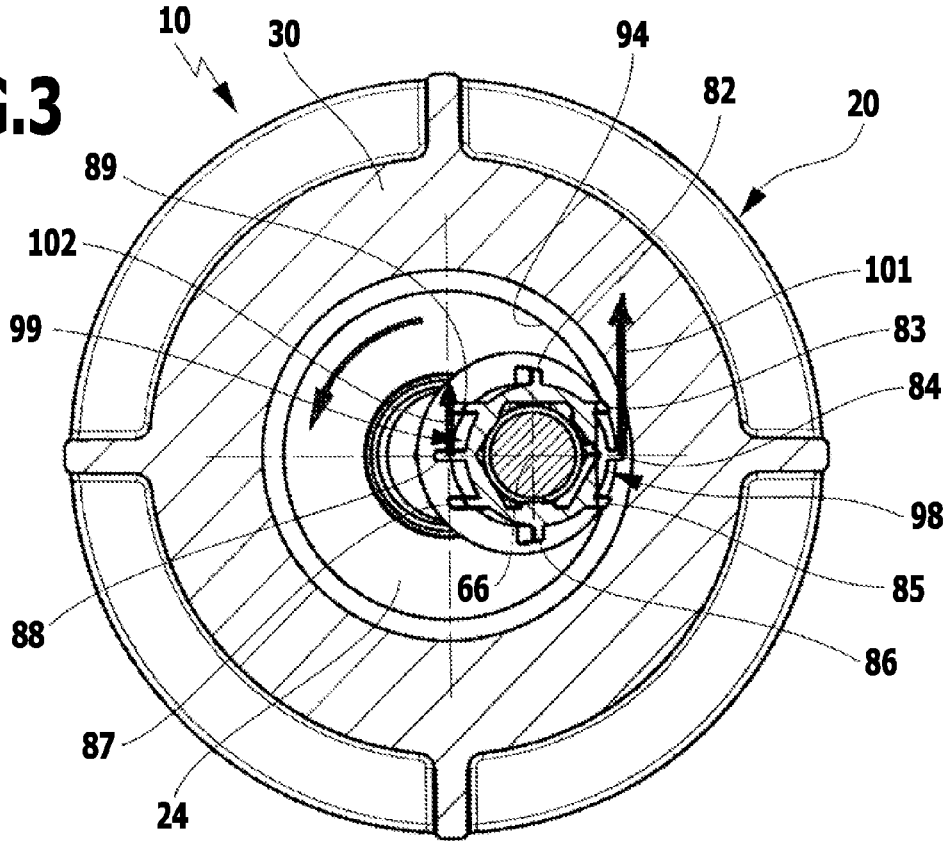
FIG. 3 shows a sectional view along line 3-3 in FIG. 1.

As explained above, during operation, the rotor nozzle 10 is supplied with liquid under high pressure, for example, water, via the jet pipe 12 from a high-pressure cleaning appliance. The liquid flows via the tangential inlets 48 into the interior 24 of the housing 20 and can leave the interior via the through-channel 68, the nozzle channel 70, the bearing ring 52 and, following this, via the central opening 50. During operation of the rotor nozzle 10, the interior 24 is filled with liquid which is caused to rotate about the longitudinal axis 38 of the housing 20 by the liquid flowing in via the tangential inlets 48. A liquid column rotating about the longitudinal axis 38 is thus formed in the interior 24. The rotating liquid column takes along the nozzle body 60 supported with its spherical front end 56 in the bearing ring 52, so that the nozzle body 60 also rotates about the longitudinal axis 38 of the housing 20. The nozzle body 60 bears against the inside wall 94 of the housing 20 via the O-ring 92 held in a rotationally fixed manner on the nozzle body 60. The longitudinal axis 66 of the nozzle body 60 is, therefore, at an inclination to the longitudinal axis 38 of the housing 20. Owing to the inclination of the nozzle body 60, the rear peripheral area 80 of the nozzle body 60 is located, at least at the level of the steel ball 72, on only one side of the longitudinal axis 38 of the housing 20, whereas the front peripheral area 78 extends both on the one side and on the opposite other side of the longitudinal axis 38. This will be clear from FIGS. 3 and 4. FIG. 3 shows a sectional view perpendicular to the longitudinal axis 38 of the housing 20 at the level of the steel ball 72, and FIG. 4 shows a sectional view perpendicular to the longitudinal axis 38 of the housing 20 approximately at the center of the front peripheral area 78.

Owing to the inclination of the nozzle body 60 relative to the longitudinal axis 38 of the housing 20, liquid flows in the same direction of flow around the rear peripheral area 80 at the level of the steel ball both on its radial outer side 98 in relation to the longitudinal axis 38 and on its radial inner side 99 in relation to the longitudinal axis 38. The velocity vectors of the liquid flowing around the rear peripheral area 80 at the level of the steel ball 72 are indicated by arrows 101 and 102 in FIG. 3. Arrow 101 shows the velocity vector of the liquid flowing around the rear peripheral area 80 on the radial outer side 98, and arrow 102 shows the velocity vector of the liquid flowing around the rear peripheral area 80 on the radial inner side 99. On the radial outer side 98, the liquid has a higher velocity than on the radial inner side, but the direction of the velocities coincides. The consequence of this is that in the rear peripheral area 80, which is characterized by an outer contour deviating from the circular shape, a considerable force can be transferred to the nozzle body 60 by the liquid column rotating about the longitudinal axis 38 of the housing 20, so that the nozzle body 60 follows the rotational movement of the liquid column about the longitudinal axis 38.

Figure 4:
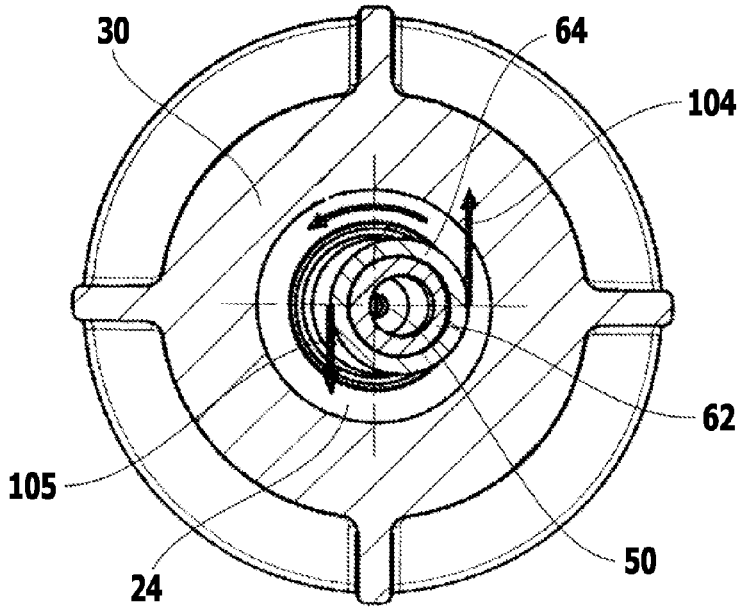
FIG. 4 shows a sectional view along line 4-4 in FIG. 1.

FIG. 4 shows the flow conditions of the liquid flowing around the nozzle body 60, which prevail in the front peripheral area 78. The front peripheral area 78 is at a relatively short distance from the bearing ring 52. In spite of its inclination to the longitudinal axis 38, the nozzle body 60 therefore has on either side of the longitudinal axis 38 peripheral areas around each of which liquid rotating about the longitudinal axis 38 flows. Arrow 104 symbolizes the velocity vector of the liquid which flows around the front peripheral area 78 on a first side, and arrow 105 symbolizes the velocity vector of the liquid which flows around the front peripheral area 78 on the second side opposite the first side. It is evident that the velocity vectors 104 and 105 are opposed to each other. The liquid flowing around the nozzle body 60 in the front peripheral area 78, therefore, has the tendency to cause the nozzle body 60 to perform an inherent rotation about its own longitudinal axis 66. However, since the front peripheral area 78 has, in contrast to the rear peripheral area 80, a circular outer contour, only a relatively low force is transferred to the nozzle body 60 by the liquid rotating about the longitudinal axis 38 of the housing 20 in the front peripheral area 78. The nozzle body 60, therefore, has a relatively low inherent rotation. However, since it is acted upon in the rear peripheral area 80 by the liquid rotating about the longitudinal axis 38 on both the inside and the outside by forces in the same direction, which owing to the non-circular outer contour in this area are of a considerable size, the nozzle body 60 is reliably set in rotational movement about the longitudinal axis 38 without these forces bringing about an inherent rotation of the nozzle body 60.

The rotational movement of the nozzle body 60 about the longitudinal axis 38 results in a compact cleaning jet, which circulates on the surface of a cone, exiting from the housing 20 of the rotor nozzle 10. This compact cleaning jet is particularly suitable for cleaning purposes.

The invention claimed is:

1. Rotor nozzle for a high-pressure cleaning appliance, comprising:

a housing, which has at least one inlet for a liquid opening tangentially into the housing, and which is provided in a front wall with a pan-shaped depression with a central opening; and a nozzle body arranged in the housing, said nozzle body having a through-channel and being supported with a front, spherical end in the pan-shaped depression, a longitudinal axis of said nozzle body being inclined to a longitudinal axis of the housing, liquid in the housing being caused to rotate about the longitudinal axis of the housing by the liquid flowing via the at least one inlet into the housing, and the nozzle body rotating together with the rotating liquid, the nozzle body bearing with a contact surface at a circumference of the nozzle body against an inside wall of the housing;

wherein:

the nozzle body has an outer contour deviating from a circular shape in a rear end area facing away from the front, spherical end; and the contact surface of the nozzle body is formed by an annular bead which is rotationally fixedly connected to the nozzle body and which is followed in a longitudinal direction of the nozzle body on both sides by areas of the nozzle body with the outer contour deviating from the circular shape.

2. Rotor nozzle in accordance with claim 1, wherein the areas of the nozzle body with the outer contour deviating from the circular shape extend right up to a rear end of the nozzle body.

3. Rotor nozzle in accordance with claim 1, wherein the nozzle body is of angular configuration in the areas with an outer contour deviating from the circular shape.

4. Rotor nozzle in accordance with claim 1, wherein the nozzle body has outwardly protruding ribs in the rear end area.

5. Rotor nozzle in accordance with claim 4, wherein at least some of the outwardly protruding ribs extend in a radial plane in relation to the longitudinal axis of the nozzle body.

6. Rotor nozzle in accordance with claim 4, wherein at least some of the outwardly protruding ribs extend perpendicularly to a radial plane in relation to the longitudinal axis of the nozzle body.

7. Rotor nozzle in accordance with claim 1, wherein the nozzle body has the outer contour with the circular shape in an end area facing the front, spherical end.

8. Rotor nozzle in accordance with claim 7, wherein the area with the outer contour with the circular shape extends over at least half of a total length of the nozzle body.

9. Rotor nozzle in accordance with claim 1, wherein the annular bead is formed by an O-ring which is arranged in an annular groove surrounding the nozzle body and which is connected in a frictionally engaged manner to the nozzle body.

10. Rotor nozzle in accordance with claim 1, wherein the nozzle body comprises in the rear end area a mass element which increases a centrifugal force.

11. Rotor nozzle in accordance with claim 1, wherein the through-channel of the nozzle body extends in an axial direction through the nozzle body.

12. Rotor nozzle in accordance with claim 11, wherein a flow straightener is arranged in the through-channel.

13. Rotor nozzle in accordance with claim 11, wherein a mass element which increases a centrifugal force and around which the liquid flows is arranged in a rear end area of the through-channel.

14. Rotor nozzle in accordance with claim 13, wherein the flow straightener follows the mass element in a direction towards the front, spherical end of the nozzle body.

* * * * *